United States Patent [19]

Thompson et al.

[11] Patent Number: 4,863,345

[45] Date of Patent: Sep. 5, 1989

[54] TURBINE BLADE SHROUD STRUCTURE

[75] Inventors: Alfred R. Thompson; Roy T. Hirst, both of Derby, England

[73] Assignee: Rolls-Royce PLC, London, England

[21] Appl. No.: 192,774

[22] Filed: May 11, 1988

[30] Foreign Application Priority Data

Jul. 1, 1987 [GB] United Kingdom ..... 8715381

[51] Int. Cl.[4] ..... F01D 11/08

[52] U.S. Cl. ..... 415/174.1; 415/134; 415/138; 415/173.6

[58] Field of Search ..... 415/170 R, 172, 174, 415/134, 136, 137, 138, 139, 170.1, 173.6, 174.1

[56] References Cited

U.S. PATENT DOCUMENTS

| | | | |
|---|---|---|---|
| 2,654,566 | 10/1953 | Boyd et al. | 415/137 |
| 3,892,497 | 7/1975 | Gunderlock et al. | 415/139 |
| 4,565,492 | 1/1986 | Bart et al. | 415/138 |
| 4,759,687 | 7/1988 | Miraucourt et al. | 415/174 |

FOREIGN PATENT DOCUMENTS

| | | | |
|---|---|---|---|
| 689270 | 3/1953 | United Kingdom | 415/139 |
| 2036882 | 3/1979 | United Kingdom . | |

*Primary Examiner*—Robert E. Garrett
*Assistant Examiner*—John T. Kwon
*Attorney, Agent, or Firm*—Cushman, Darby & Cushman

[57] ABSTRACT

The invention is aimed at avoiding excessive wear of the tips of the turbine blades in deceleration of a gas turbine engine, and provides a control ring which is loosely supported by fixed structure. The control ring is made from a material which reacts more slowly to thermal changes than the support structure and firstly being loosely supported thereby, avoids the stresses which would be otherwise experienced by the fixed joining of differing materials for operation in varying temperatures. Secondly, on deceleration of the associated engine with consequent fall in operating temperature, the control ring contracts more slowly than the turbine assembly and so avoids engaging the shrouds abradable linings with the tips of the blades.

9 Claims, 3 Drawing Sheets

TURBINE BLADE SHROUD STRUCTURE

FIELD OF THE INVENTION

The present invention concerns a shroud which in use surrounds the extremities of a stage of turbine blades in a gas turbine engine.

BACKGROUND OF THE INVENTION

An ommnipresent problem which is met by designers of gas turbine engine turbine structures, is the relative thermal reaction characteristics of the parts which make up the turbine structure. Thus parts which are constructed from the same type of material may differ in thermal growth because some of the parts operate in a higher temperature than the remainder. Moreover, some of those parts may rotate at high speed, so that the centrifugal force which is generated aggrevates the differing rate of dimensional change between rotating and static parts.

Attempts have been made to construct an assembly of parts, wherein the material of some fixed parts have thermal reaction characteristics which differ from the rotating parts, so that, having regard to the local environment in which they work, they may expand and contract in a manner which is matched to the corresponding movements of the rotating parts. A drawback however, is that where parts which have differing thermal reaction characteristics are fixed together, unacceptable stresses are generated at the joint.

SUMMARY OF THE PRESENT INVENTION

The present invention seeks to provide an improved turbine blade shroud assembly.

According to the present invention a gas turbine engine blade shroud assembly comprises a ring loosely retained in the axial and radial senses on fixed engine structure, a turbine blade shroud comprising a plurality of side abutting segments, each being hung from a radial face of said ring and locating in gas sealing, relatively movable relationship with said fixed structure and wherein the ring is constructed from a material which has slower thermal reaction characteristics then the material of the fixed structure.

Preferably the fixed structure comprises a flanged member and includes an internal annular groove and each shroud segment is provided with an upstream flange portion which lies within said groove such that relative radial movement may occur therebetween in gas sealing manner during operation.

Preferably the ring is loosely retained in the radial sense by elongate features which project from the downstream face of the flange of the flanged member and loosely locate within complementary features formed in the ring.

The elongate features and complementary features may be rectangular in cross-section.

Preferably the ring is loosely retained in the axial sense by having an axial length which is less than the projecting lengths of the elongate features and clamping a further ring to the extremities thereof.

The further ring may comprise an inwardly turned flange on a cylindrical member, the cylindrical portion of which overlaps the elongate features and slidingly engages within a further cylindrical member which is fixed to a turbine outer casing.

Preferably each blade shroud segment is hung from dowel pins affixed in a radial face of said ring.

Each blade shroud segment may include a gas sealing strip which bridges the interface between adjacent side edges of adjacent pairs of shrouds and nests in opposed slots.

BRIEF DESCRIPTION OF THE DRAWINGS

The invention will now be described, by way of example and with reference to the accompanying drawings in which.

DETAILED DESCRIPTION OF THE PREFERRED EMBODIMENT

Figure 1:
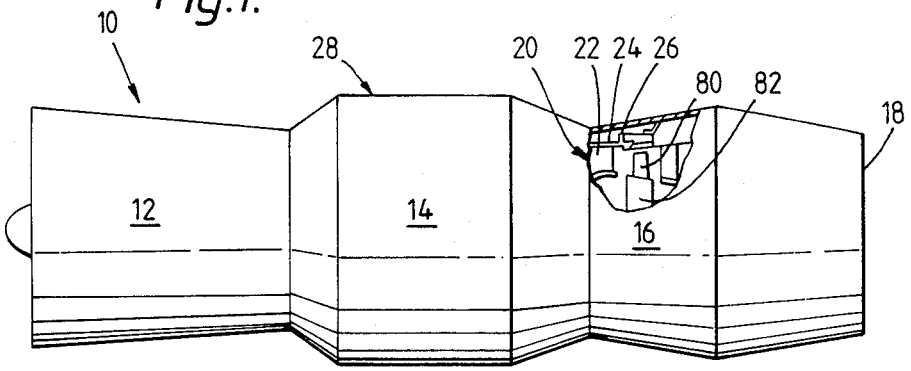
FIG. 1 is a diagrammatic view of a gas turbine engine which incorporates an embodiment of the present invention.

Referring to FIG. 1. A gas turbine engine 10 has in flow series, a compressor 12, combustion equipment 14, a turbine section 16 and an exhaust nozzle 18.

The combustion equipment 14 terminates in a discharge nozzle 20 which includes a peripheral array of nozzle guide vanes 22 which form part of fixed structure.

The guide vanes 22 have a common annular shroud 24 which includes an annular flange 26.

The engine 10 is enclosed in a casing 28 which is made up of a number of axially aligned cylinders and/or frusto conical portions which are not identified individually.

Figure 2:
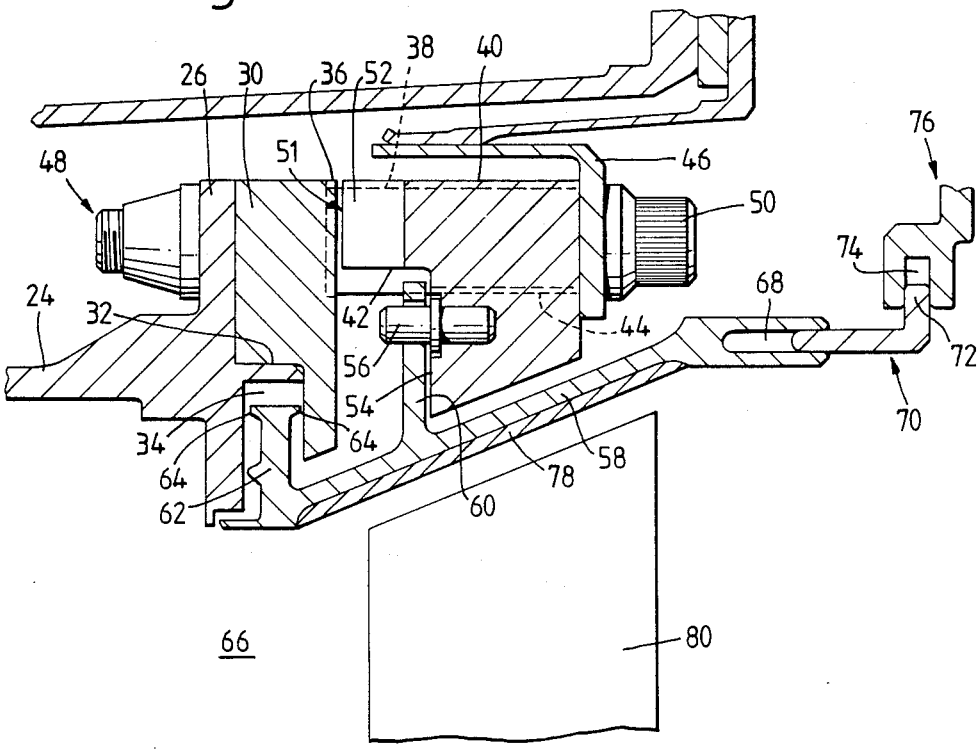
FIG. 2 is an enlarged part view of the exposed turbine portion of FIG. 1.

Referring now to FIG. 2. A ring 30 is spigot located at 32 to the downstream face of the guide vane shroud flange 26. A radially inner lip 32 on the ring 30 combines with a radially inner portion of the downstream face of the flange 26, to define a radially inwardly opening groove 34.

The outer portion of the downstream face of the ring 30 has a number of equi-angularly spaced shallow recesses 36 formed therein. The recesses 36 have a square profile and each receives an end of a respective bar 38 which also has a corresponding cross-sectional profile which fits closely within its respective recess 36. This is more clearly seen in FIG. 3.

Still referring to FIG. 2. A control ring 40 has an annular step 42 formed in its upstream face and grooves 44 equal in number and spacing to the bars 38 formed in its outer periphery. Whatever material is utilised for the structure described herein, the material from which the control ring 40 is made should be of a kind, the thermal reaction characteristics of which differ by way of being slower to react to changes in temperature. In the present example the material from which the structure is made which supports the control ring 40 is known as N80A (trademark) which is a nickel based alloy. The control ring 40 however, is made from N.907 (trademark) again a nickel based alloy, but varying in the minor constitutements and their quantities.

The control ring 40 is positioned against the ring 30 by aligning the grooves 44 with the bars 38 and moving the ring 40 towards the ring 30. The magnitude of the dimensions of the grooves 44 relative to those of the bars 38 is such as to ensure that limited relative movement in the radial sense between the bars 38 and the ring 40 is enabled. Further, the axial thickness of the ring 40 relative to the lengths of the bars 38 is such as to enable limited relative axial movement between the ring 40 and the bars 38 after a clamping ring 46 is fixed to the downstream ends of the bars 38. The fixing is achieved via nut and bolt assemblies 48 in which the bolts 50 pass right through the assembly of the flange 26, the ring 30, the bars 38 and the clamping ring 46. The control ring 40 is thus loosely cross key located on the remainder of the assembly.

The clamping ring 46 includes a cylindrical portion extending over the bars 38 and slidingly engaged with a further cylindrical member (unnumbered) which is fixed to the turbine casing 28.

A spigot 51 which is generated when the step 42 is formed in the control ring 40, is relieved at local places to provide cooling air flow paths 52. These are more clearly seen in FIG. 3.

Referring again to FIG. 2. An upstream facing face 54 on the control ring 40 has a number of equi-angularly spaced pairs of dowels 56 protruding therefrom from each of which pair a turbine blade shroud segment 58 is suspended via pairs of pedestals 60.

The leading edge of each shroud 58 has a radially outwardly turned flange 62 which includes straight lands 64 on upstream and downstream faces. The flange 62 locates in the groove 34 and via the straight lands 64 cooperates with the walls thereof to maintain leakage of turbine gases from the turbine annulus 66 to the area externally of the shroud structure at a minimum.

The downstream end of each shroud segment 58 has an axial groove 68 to which the end of a flanged cylinder 70 locates. The flanged cylinder 70 in turn locates via its flange 72 in a radially inwardly operating annular groove 74 in fixed structure 76.

The radially inner surface of each shroud segment 58 is lined with an abrasive material 78 in known manner, and the shroud segments 58 in toto, surround a stage of turbine blades 80, only the radially outer portion of one of which is shown in FIG. 2.

Figure 3:
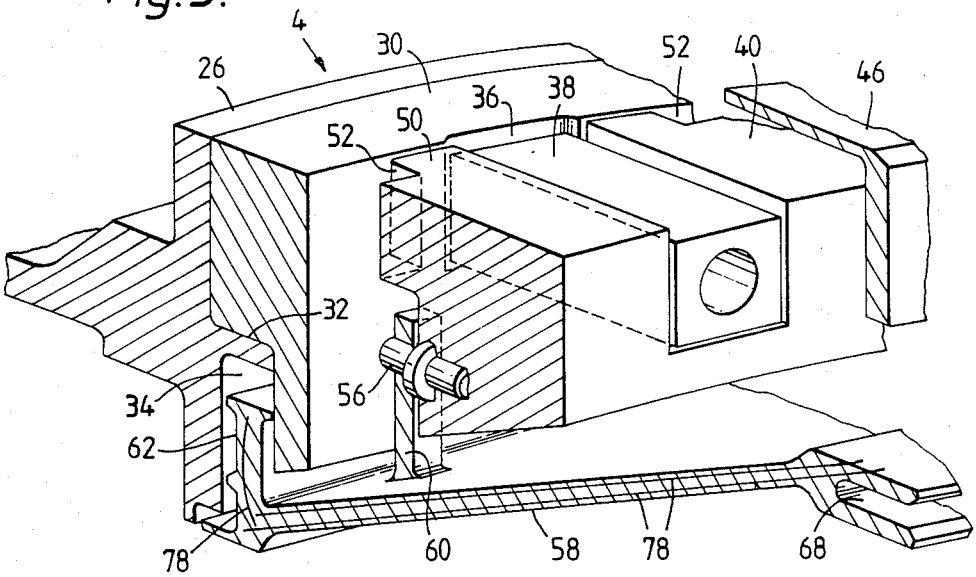
FIG. 3 is a pictorial view of FIG. 2.
Figure 4:
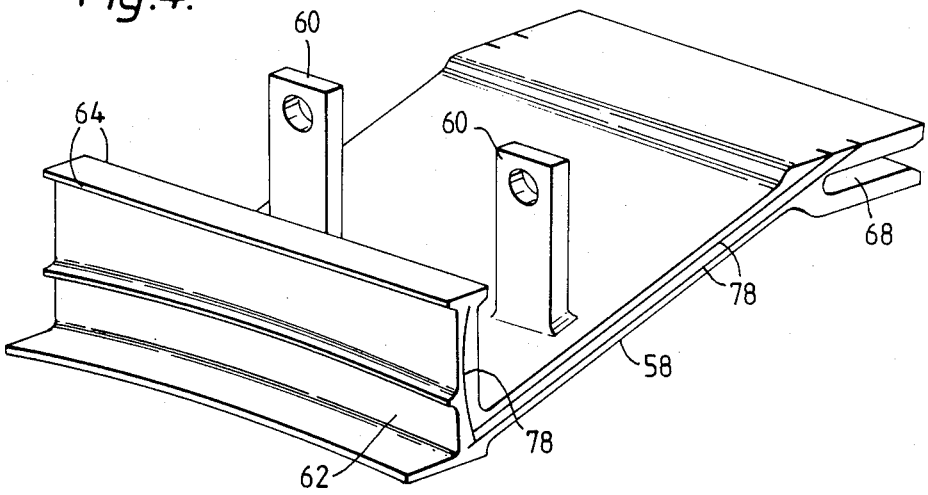
FIG. 4 is a pictorial part view of FIG. 3 in the direction of arrow 4.

Referring now to FIGS. 3 and 4. Slots 78 are provided in the side edges of each shroud segment 58 and sealing strips (not shown) are fitted in them in known manner i.e. each sealing strip (not shown) extends for the length of respective slots 78, the adjacent edges of adjacent segments 58 and thus bridges a small gap (not shown) between those adjacent edges.

In operation of the gas turbine engine 10, on rotary acceleration of the turbine disc 82 (FIG. 1) the centrifugal force and increase in temperature experienced thereby, causes the disc 82 and blades 80 to extend in all radial directions, relative to the axis of rotation of the assembly. The structure 26 and 30, which is affected by the heat generated by the hot gases which flow over the guide vanes (not shown) which are surrounded by the shroud 26 will also grow in the radial sense, as will the control ring 40. However, the structure 26 and 30, being made from a material which reacts more rapidly to thermal changes than does the material from which the control ring 40 is made, will grow relative to the control ring 40.

The loose manner in which the control ring 40 is supported by the structure 26,30 and 38 however, ensures avoidance of generation of stresses between them.

The initial growth of the turbine disc 82 and its associated blades 80 is rapid, whereas the growth of the control ring 40 and therefore the movement outwards of the blade shroud segments 58 is relatively slow. Consequently, fouling of the tips of the blades 80 in the abradable lining 78 occurs and the original blade tips are worn away. The magnitude of wear is greatest in the early use of the engine to power say an aircraft and the wear described hereinbefore occurs during take off of the associated aircraft.

On throttling of the engine so as to achieve the cruise regime, the gas temperature and centrifugal forces both reduce with the result that the structure 26, and 30 and the disc and blades 82,80 contract radially inwards.

The control ring 40 also contracts radially inwardly, but at a slower rate than the aforementioned structure. Consequently, collision between the blade shroud segments 58 and the tips of the blades 80 and therefore further wear, is avoided.

The use of the control ring 40 of the present invention as described hereinbefore, ensures that after initial wear of the tips of the blades 80 as they grow during acceleration of the engine 10, and the cruise condition thereof is stabilised, the resultant annular gap which then exists between the tips of the blades 82 and the abradable layer 78 is maintained at a minimum. The specific fuel consumption of the engine 10 is thus improved.

Movement of the shroud segments 58 in radial directions may be bodily, or pivotal. If the movement is bodily, then the flanged ring 70 will also move bodily, and its flange 72 will slide in the groove 74. If the movement is pivotal, then the shroud segments 58 will pivot about their downstream ends i.e. about the engaging ring 70 and groove 68.

The dimensional proportions of the control ring 40 relative to those of the supporting structure 26,30 and 38 will be calculated, taking into account their different reaction characteristics to the thermal changes that their operating environment imposes upon them.

In an alternative embodiment, the elongate, rectangular features 38 are substituted by studs (not shown) and the complimentary rectangular features 44 are substituted by drilled holes (not shown) the diameters of which are sufficiently large relative to the diameters of the studs (not shown) as to give the designed loose fit therebetween.

Figure 5:
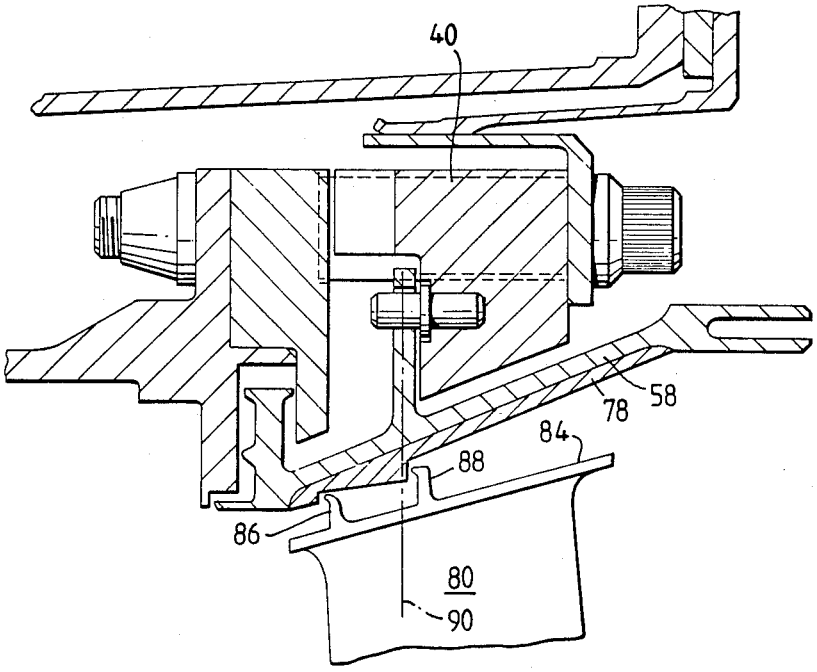
FIG. 5 is an alternative embodiment of the present invention.

Referring now to FIG. 5. The blades 80 in this embodiment have integral shrouds 84, each of which carries a pair of seal lands 86 and 88 in known manner. Where such blades are used in conjunction with the present invention, the shroud segments 58 should be suspended from the control ring 40 in a plane 90 which is as near coincident with the plane containing the seal land 88 as is possible. This is because a pressure drop occurs in the gases in a direction chordally of the blades 80, and it is known that the greatest pressure drop occurs across the downstream seal land 88. The pressure change acts on the shroud segments 58 such that they tilt about their suspension means i.e. the dowel pins 56. The coincidence or near coincidence of the tilt point and the seal land 88 however, ensures that the minimum clearance between the seal land 88 and the abradable layer 78 on each shroud segment 58 is maintained.

We claim:

1. A gas turbine engine blade shroud assembly comprising a first ring loosely retained in the axial and radial senses on fixed engine structure and a turbine blade shroud comprising a plurality of side abutting segments, each being hung from a radial face of said first ring and locating in gas sealing relatively movable relationship with said fixed structure and wherein the first ring is constructed from a material which has slower thermal reaction characteristics than the material of the fixed structure.

2. A blade shroud assembly as claimed in claim 1 wherein each shroud segment is hung from dowel pins affixed to a radial face of said first ring.

3. A gas turbine engine blade shroud assembly comprising a first ring loosely retained in the axial and radial senses on fixed engine structure and a turbine blade shroud comprising a plurality of side abutting segments, each being hung from a radial face of said first ring and located in gas sealing relatively movable relationship with said fixed structure and wherein the first ring is constructed from a material which has slower thermal reaction characteristics than the material of the fixed structure, wherein the fixed structure comprises a flanged member and includes an internal annular groove and each shroud segment is provided with an upstream flange portion which lies within said groove such that relative radial movement may occur therebetween in gas sealing manner during operation in situ.

4. A blade shroud assembly as claimed in claim 3 wherein the first ring is loosely retained in the radial sense by elongate features which project from the downstream face of the flange of the flanged member and loosely locate within complementary features which are formed in the first ring.

5. A blade shroud assembly as claimed in claim 4 wherein the elongate features and their complementary features are rectangular in cross-section.

6. A blade shroud assembly as claimed in claim 4 or claim 4 wherein the first ring is loosely retained in the axial sense by having an axial length which is less then the projecting lengths of the elongate features and clamping a further ring to the free extremities of the elongate features.

7. A blade shroud assembly as claimed in claim 6 wherein the further ring comprises a cylindrical member having a radially inwardly turned flange and a cylindrical portion, the cylindrical portion overlaps the elongate features and slidingly engages within a further cylindrical member which is fixed to a turbine outer casing.

8. A gas turbine engine blade shroud assembly comprising a first ring loosely retained in the axial and radial senses on fixed engine structure and a turbine blade shroud comprising a plurality of side abutting segments, each being hung from a radial face of said first ring and located in gas sealing relatively movable relationship with said fixed structure and wherein the first ring is constructed from a material which has slower thermal reaction characteristics than the material of the fixed structure, wherein the interface between adjacent shroud edges is bridged by a sealing strip, each edge of which is received in a slot in the respective shroud edge.

9. A gas turbine engine blade shroud assembly comprising a first ring loosely retained in the axial and radial senses on fixed engine structure and a turbine blade shroud comprising a plurality of side abutting segments, each being hung from a radial face of said first ring and located in gas sealing relatively movable relationship with said fixed structure and wherein the first ring is constructed from a material which has slower thermal reaction characteristics than the material of the fixed structure, wherein the blades to be shrouded have integral shrouds with a pair of axially spaced seal lands thereon and the proportions of the blade shroud assembly are such that when in situ around a stage of said blades, the plane in which said shroud assembly is hung is coincident or near coincident with the plane containing the axially downstream seal land.

* * * * *